US006077023A

United States Patent [19]

Troppman, III

[11] Patent Number: 6,077,023

[45] Date of Patent: Jun. 20, 2000

[54] TABLE LIFT AND TRANSPORT MECHANISM

[76] Inventor: George Louis Troppman, III, 13920 Blue Mountain Dr., Maugansville, Md. 21767

[21] Appl. No.: 09/145,643

[22] Filed: Sep. 2, 1998

[51] Int. Cl.[7] ..... B62B 1/06

[52] U.S. Cl. ..... 414/444; 280/43; 280/43.17; 254/4 R

[58] Field of Search ..... 414/444, 446, 414/490, 495, 498; 280/43, 43.1, 43.17; 254/8 R, 8 C, 127, 4 R, 4 C

[56] References Cited

U.S. PATENT DOCUMENTS

| | | | |
|---|---|---|---|
| 723,692 | 3/1903 | Litsey | 280/43 |
| 1,027,686 | 5/1912 | Bollinger | 280/43 |
| 1,445,453 | 2/1923 | Sheller | 280/43.1 |
| 2,670,031 | 2/1954 | Melges | 280/43.1 |
| 2,681,740 | 6/1954 | Schueler | 414/444 |
| 2,854,044 | 9/1958 | Raguse | 280/43.1 |
| 3,477,737 | 11/1969 | Podiak | 280/43 |
| 3,553,556 | 1/1971 | Hall | 214/512 |
| 3,578,353 | 5/1971 | Lockhart | 414/444 |
| 4,637,770 | 1/1987 | Swadell | 414/495 |
| 4,693,660 | 9/1987 | LaCroix | 414/495 |
| 5,056,977 | 10/1991 | May | 414/495 |
| 5,308,094 | 5/1994 | McWhorrter et al. | 280/43.17 |
| 5,308,213 | 5/1994 | Gilbertson | 414/495 |
| 5,788,251 | 8/1998 | Johnson | 280/43.17 |
| 5,876,173 | 3/1999 | English, Jr. | 414/495 |
| 5,893,571 | 4/1999 | Nowell | 280/43 |

*Primary Examiner*—Robert P. Olszewski
*Assistant Examiner*—Isobel A. Parker
*Attorney, Agent, or Firm*—Joseph J. Zito

[57] ABSTRACT

A table lifting and transporting mechanism with ground contact wheels, a table support portion and a mechanism for transferring the majority of the weight of the table to the wheels so that the table is supported generally at its center of gravity. The mechanism is adapted to engage the underside of the table and includes a winch for lowering its wheels into contact with the ground after positioning. The winch allows for the table to be raised after the wheels have contacted the ground, thus transferring the weight of the table from the table legs to the wheels.

7 Claims, 4 Drawing Sheets

TABLE LIFT AND TRANSPORT MECHANISM

BACKGROUND OF THE INVENTION

The present invention relates to mechanisms for lifting large heavy objects. More specifically, the present invention relates to mechanisms for lifting and supporting the weight of a large object to enable relocation of the object by a single individual.

Large objects with substantial weight can be difficult to move due to the combination of weight and size of the object. Sometimes an object can be too massive for a single person and even heavy when lifted by two persons. Other objects can be difficult to lift and move because the dimensions of the object make supporting the weight of the object while moving difficult.

Tables are often large, heavy and difficult to transport, even with the assistance of a second person. Even with the aid of a second person, half the weight of the table must be lifted by each person and then movement is restricted to short stutter steps, while attempting to maintain the balanced weight of the table. Often a second person is unavailable when a table needs to be moved.

In some situations, tables are moved quite often and most always by only one person. For example picnic tables often need to be moved every time the grass is mowed. This is a problem for homeowners and maintenance personnel at parks or other areas with picnic tables. Often the individual mowing must endeavor to move the table alone. A heavy picnic table often cannot be fully lifted by a single person because of a combination of the weight and inability to apply the lifting force at or near the center of gravity of the table. As a result, the table is often lifted one end at a time and walked to a new position. This lifting applies a torque to the table and table legs which can weaken the table and eventually result in damage or failure of the table and/or table legs.

SUMMARY OF THE INVENTION

It is an object of the present invention to provide a mechanism to allow a single individual to lift and move a bulky object with minimal effort.

It is an object of the present invention to provide a lifting mechanism which lifts a table or other object at or near its center of gravity to enable stable lifting of the object.

It is a further object of the present invention to provide a supporting mechanism which includes the ability to be rolled in order to reposition the object being lifted and supported.

It is still another object of the present invention to allow relocation of a table while avoiding the application of damaging torque to the table.

The present invention includes a frame having a central portion for supporting the table, a lever pivotally attached to the frame proximate the supporting portion, wheels attached to the opposite end of the lever and a winch mechanism for applying force to the wheeled end of the lever, rotating the lever about it pivot to move the wheels into contact with the ground. After the wheels contact the ground, the winch is operated to raise the table legs off the ground, shifting the weight of the table onto the wheels, supporting the table on the central portion of the frame.

BRIEF DESCRIPTION OF THE DRAWINGS

For a better understanding of the nature of the present invention, reference is had to the following figures and detailed description, wherein like elements are accorded like reference numerals, and wherein.

DETAILED DESCRIPTION OF PREFERRED EXEMPLARY EMBODIMENTS

Figure 1:
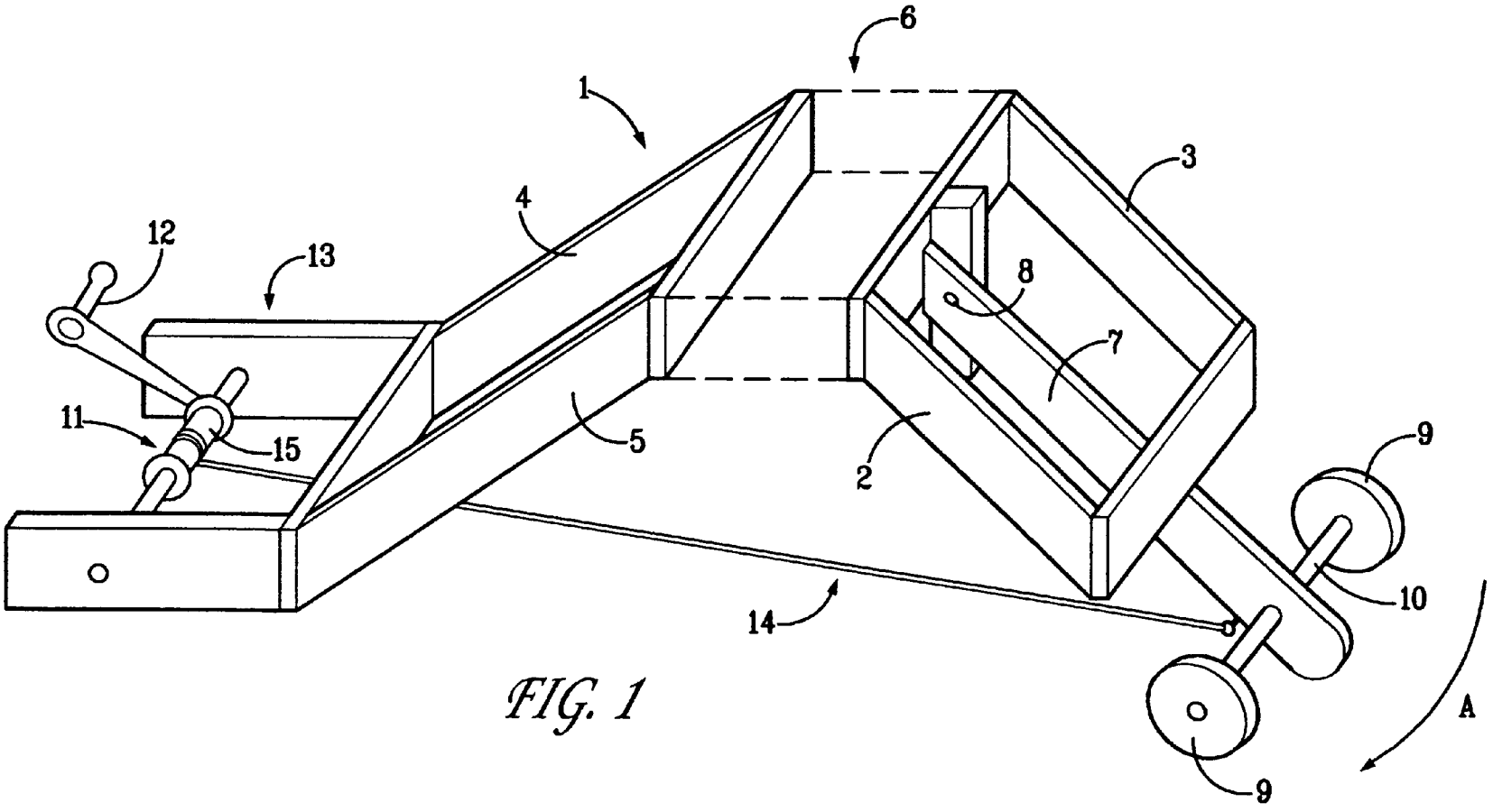
FIG. 1 is a perspective view an embodiment of the present invention.
Figure 2:
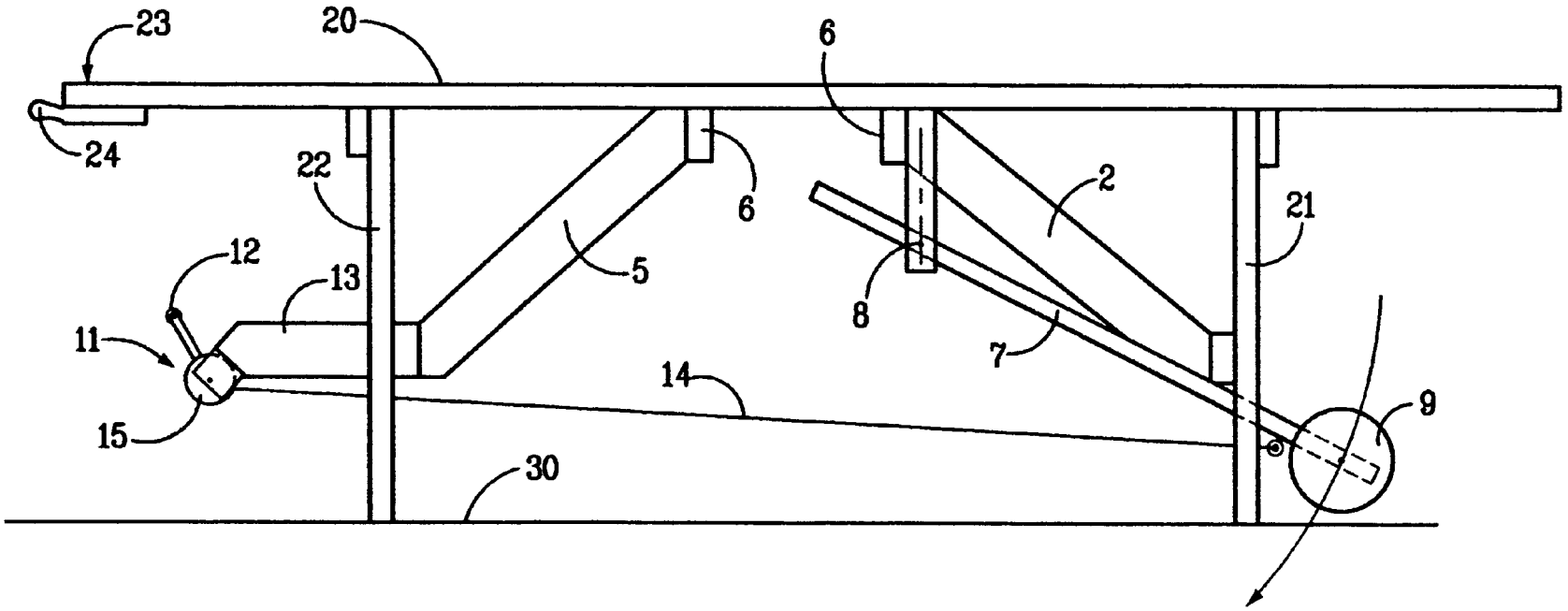
FIG. 2 is a side view of an embodiment of FIG. 1, with positioned under a table with wheels raised.
Figure 3:
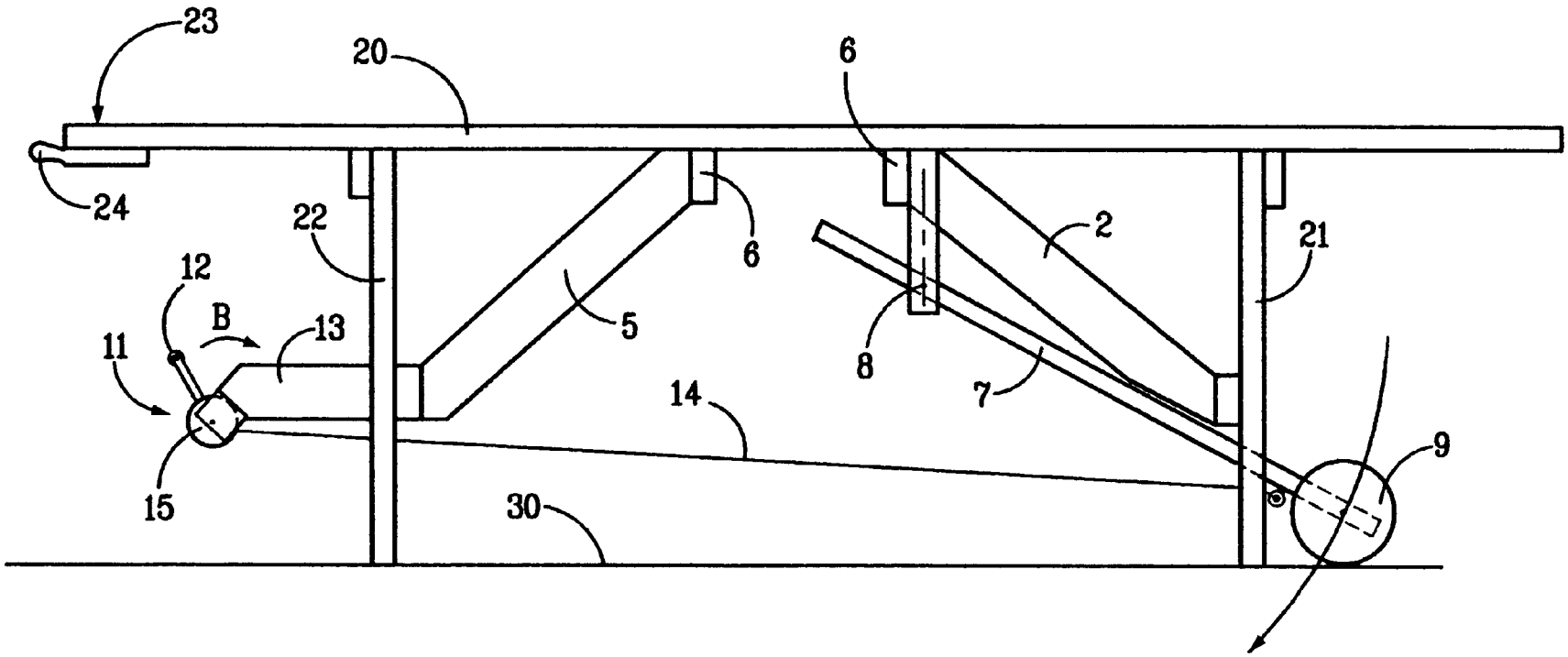
FIG. 3 is a side view of an embodiment of FIG. 1, the wheels lowered int o contact with the ground.
Figure 4:
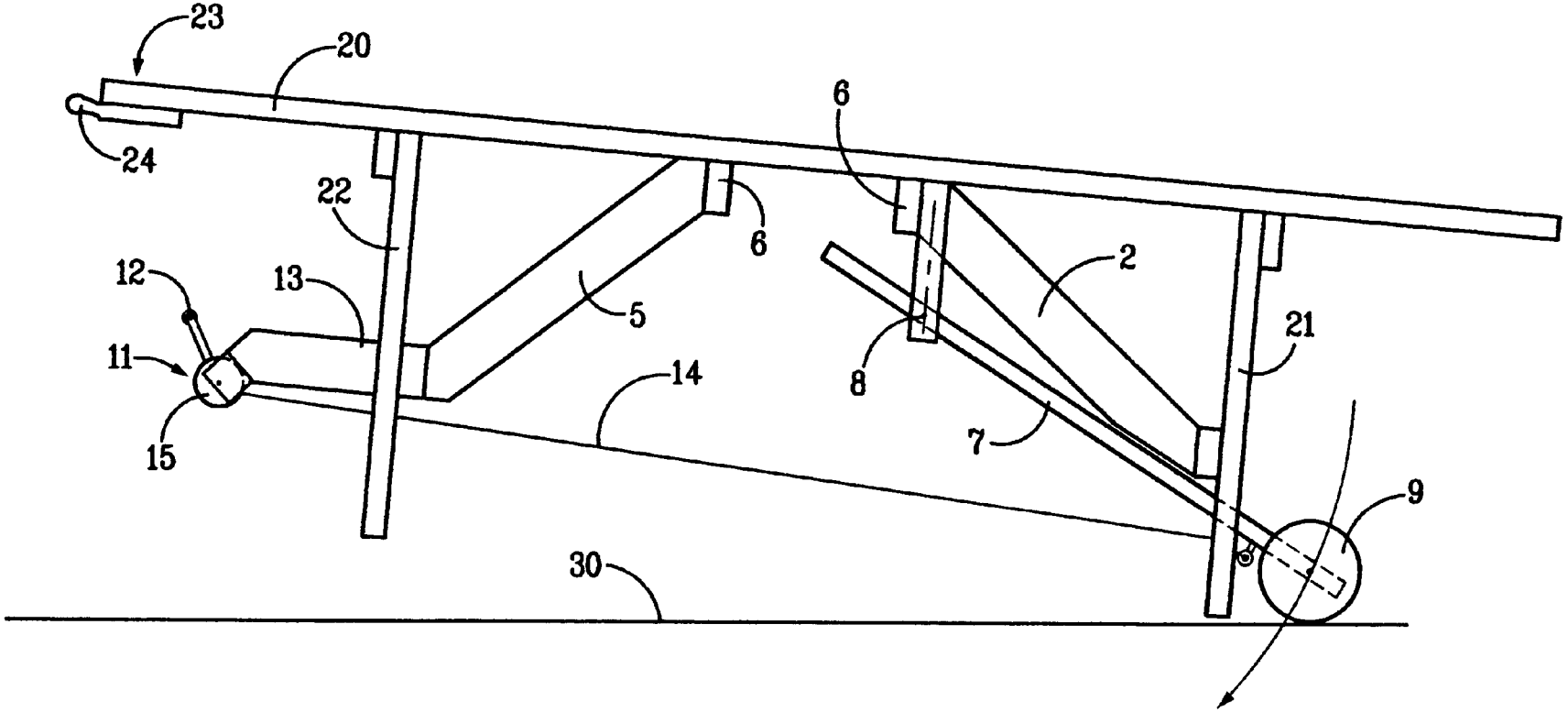
FIG. 4 is a side view of an embodiment of FIG. 1, with the weight of the table shifted from the table legs to the wheels of the present invention.

FIG. 1 illustrates an embodiment of the present invention constructed for lifting and transporting a table. The device has a frame 1 which can include four brace members 2, 3, 4 and 5. The four brace members 2, 3, 4, and 5 extend from a central support 6 downward to the legs of the table as illustrated in FIGS. 2–4. The frame can be constructed in a number of alternative designs, including reducing the width of the central support and angleing the brace members downward and outward, or eliminating two of the braces,.

The central support portion 6 of the frame includes a pivot mounting 8 for a lifting lever 7. Lifting lever 7 is pivotally attached to the central support 6 at pivot 8. A wheel or pair of wheels 9 are provided at the lower end of lever 7, mounted to lever 7 on axle 10.

A winch 11 with a handle 12 is mounted on extension 13 at the opposite end of the frame 1 from the wheels 9. A tensioning member such as cable 14, connects winch 11 with lever 7 near the wheels 9. When winch 11 is operated, cable 14 is wound around spool 15 and lever 7 is rotated about pivot 8 in the direction indicated by arrow A. The process for lifting the table is better illustrated in the series of FIGS. 2–4.

FIGS. 2 through 4 illustrate the device of the present invention in use under a table 20 with pairs of legs 21 and 22. Central support 6 can be attached to the middle area of the table 20 with the braces 2, 3, 4 and 5 attached to the table legs 21 and 22. Alternatively the device can be positioned below the table 20 and held against the underside of the table and the table legs 21 by the weight of the table 20 resting on the device.

As illustrated in FIG. 2, when not in use, the wheels 9 may optionally be suspended above the ground 30. As illustrated in FIG. 3, when winch handle 12 is rotated in the direction indicated by arrow B, cable 14 is wound around spool 15 and wheels 9 are lowered into contact with ground 30. As cable 14 is drawn further around winch spool 15, FIG. 4, wheels 9 are lowered so as to lift legs 21 of the table off the ground and support the majority of the weight of the table on the central support 6 of the device. The weight of the table 20 is shifted from the legs of the table to the device without applying any torque or stress to the table 20 or the table legs 21 and 22. The table 20 is only slightly tilted during the lifting process.

To transport the table, the user grasps the opposite end 23 of the table 20 and lifts the weight of the table 20 remaining on legs 22, FIG. 4. Optional handles 24 can be provided for lifting the remaining end of the table 20. The table 20 can be moved by rolling on wheels 9 which support the majority of the weight of the table 20. Transporting the table by a single individual becomes a manageable task.

The device of the present invention can be stored separately from the table and positioned beneath the table when desired for lifting and transporting or can be attached to the table and stored in the wheels raised position until necessary for lifting and transporting.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

I claim:

1. A lifting and transporting device, comprising:

a central support attached to an underside of a table, proximate the center of gravity of said table;

a plurality of braces extending from said central support to a set of legs of said table;

a lever having a first end pivotally attached to said central support and extending downwardly from said support generally toward a first set of legs of said table adjacent to a first end of said table;

ground contact wheels rotatably attached to said lever adjacent to a second end of said table; and a winch positioned proximate the second end of said table and having a cable operatively connected to said lever proximate said second end of said lever, wherein operation of said winch lowers said wheels into contact with said support surface and raises at least said first leg from said surface, transferring a substantial portion of the weight of said table to said wheels and said support.

2. A lifting and transporting device, comprising:

a central support;

a plurality of brace members extending angularly downward and away from said central support;

a lever comprising a proximal end and a distal end, the proximal end of the lever being pivotally attached to the central support, and the distal end of the lever being rotatably secured to a wheel; and a winch positioned proximate a proximal end of said device, said winch comprising a tensioning member extending from said winch to said lever, wherein operation of said winch lowers said wheel into contact with a support surface and transfers weight to said wheel.

3. The lifting and transporting device of claim 2, wherein said tensioning member is a cable.

4. The lifting and transporting device of claim 2, wherein the tensioning member transfer force between said lever and said winch.

5. The lifting and transporting device of claim 4, wherein rotation of said winch in a counter-clockwise direction reduces tension in said cable causing said wheel to be suspended off the support surface.

6. The lifting and transporting device of claim 2, wherein rotation of said winch in a clockwise direction increases tension in said cable causing said wheel to be lowered into contact with the support surface.

7. The lifting and transporting device of claim 2, wherein said device is adapted to receive a table.

* * * * *